United States Patent [19]

Stahli et al.

[11] Patent Number: 4,982,478

[45] Date of Patent: Jan. 8, 1991

[54] CARDING MACHINE WITH MODULAR SUBDIVISION OF THE CARDING ZONES

[75] Inventors: Urs Stahli, Turbenthal; Peter Fritzsche, Winterthur; Marcel Bosshard, Eschlikon; Robert Demuth, Nuerensdorf, all of Switzerland

[73] Assignee: Maschinenfabrik Rieter AG, Winterthur, Switzerland

[21] Appl. No.: 424,505

[22] Filed: Oct. 20, 1989

[30] Foreign Application Priority Data

Oct. 20, 1988 [DE] Fed. Rep. of Germany ..... 3835776

[51] Int. Cl.[5] ..... D01G 15/26

[52] U.S. Cl. ..... 19/102; 19/98; 19/104

[58] Field of Search ..... 19/98, 101, 102, 104, 19/105, 109, 113

[56] References Cited

U.S. PATENT DOCUMENTS

| | | | |
|---|---|---|---|
| 266,334 | 10/1882 | Whitehead | 19/102 |
| 431,685 | 7/1890 | Canning | 19/104 |
| 446,015 | 2/1891 | Prest | 19/104 |
| 628,830 | 7/1899 | Mills et al. | 19/173 |
| 2,369,893 | 2/1945 | Gwaltney | 19/98 |
| 2,627,631 | 2/1953 | Castell | 19/98 |
| 2,683,901 | 7/1954 | Griswold | 19/98 |
| 3,373,461 | 3/1968 | Bessette et al. | 19/98 |
| 3,396,432 | 8/1968 | Robinson | 19/98 |
| 3,402,432 | 9/1968 | Kalwaites | 19/98 |
| 4,286,357 | 9/1981 | Harrison, Sr. | 19/104 |
| 4,757,575 | 7/1988 | Varga | 19/103 |
| 4,776,065 | 10/1988 | Rake et al. | 19/105 |
| 4,779,310 | 10/1988 | Leifeld | 19/240 |
| 4,797,980 | 1/1989 | Jagst | 19/109 |

FOREIGN PATENT DOCUMENTS

| | | | |
|---|---|---|---|
| 0195756 | 3/1985 | European Pat. Off. | 19/104 |
| 2133929 | 1/1972 | Fed. Rep. of Germany . | |
| 7811691 | 9/1982 | Fed. Rep. of Germany . | |
| 3811679 | 10/1989 | Fed. Rep. of Germany . | |
| 2619 | of 1859 | United Kingdom | 19/104 |
| 9229 | of 1894 | United Kingdom | 19/104 |
| 400971 | 11/1933 | United Kingdom | 19/104 |
| 1353735 | 5/1974 | United Kingdom . | |

*Primary Examiner*—Werner H. Schroeder
*Assistant Examiner*—John J. Calvert
*Attorney, Agent, or Firm*—Burns, Doane, Swecker & Mathis

[57] ABSTRACT

A card wherein at least the pre-carding zone, located between the licker-in and the revolving flats is subdivided into a multiplicity of angular ranges with respect to the axis of the main cylinder, all of which have a unified angular extension or an integral multiple of this unified angular extension. In this zone, or in several of these zones on both sides of the main cylinder there are exchangeable fastening plates, lying opposite to each other in pairs, which can be fitted to the card shells, whereby the angular extension of the fastening plates around the axis of the main cylinder corresponds to the unified angular extension or to an integral multiple of this angular extension. Each pair of fastening plates with the component parts fitted thereto forms an exchangeable, pre-adjusted module whereby the components comprise groups or combinations of the same or different pieces of equipment of a card and each has an angular extension around the axis of the main cylinder which corresponds to the unified angular extension or to an integral multiple of this unified angular extension.

23 Claims, 10 Drawing Sheets

CARDING MACHINE WITH MODULAR SUBDIVISION OF THE CARDING ZONES

BACKGROUND OF THE INVENTION

The present invention relates to a card comprising a licker-in, a main cylinder and a doffer as well as a main carding zone defined by a revolving flat arrangement, whereby, viewed in the circumferential direction of the main cylinder, there is a pre-carding zone between the licker-in and the main carding zone, a recarding zone between the main carding zone and the doffer and an intermediate carding zone between the doffer and the licker-in.

With the use of cards, different card equipment is fitted in the pre-carding zones and, occasionally, also in the recarding zones and the intermediate carding zones, whereby the type and sequence of the card units is selected to correspond to the characteristics of the fibres to be processed. For example, usually the staple length, type and degree of soiling of the fibres to be processed is taken into account.

The card equipment itself can be card rods, for example, which are fitted with needle or saw tooth clothing, or guide rods, knife rods, main cylinder cover plates or cleaning devices.

Although it does not often occur that the equipment of a card is changed, for example, in order to suit other fibre characteristics or because wear must be taken into account, nevertheless, such an alteration of the card equipment is expensive and takes time, above all from the point of view of setting the card equipment, so that the preset clearance to the needle clothing of the main cylinder is maintained. Also, the desired equipment of the card cannot always be realized, because of the limited space available in the pre-carding zone.

SUMMARY OF THE INVENTION

According to the invention, a card is provided which enables such equipment of the card to be fitted or dismantled rapidly in the pre-carding zone or if necessary in other carding zones, without special limitations with regard to the selection and grouping of the special card equipment and with a minimum of effort with regard to the adjustment.

According to the invention, at least the pre-carding zone is subdivided into a multiplicity of angular ranges, with respect to the axis of the main cylinder. All of the angular ranges have a unified angular extension or an integral multiple of this unified angular extension. In this zone, or in several of these zones on both sides of the main cylinder, there are exchangeable fastening plates, lying opposite to each other in pairs, which can be fitted to the card shells, whereby the angular extension of the fastening plates around the axis of the main cylinder corresponds to the unified angular extension or an integral multiple of this angular extension. Furthermore, every pair of fastening plates with the parts fitted thereon, forms an exchangeable, preadjusted module, whereby the parts named comprise groups or combinations of the same or different pieces of equipment of a card and each has an angular extension around the axis of the main cylinder which corresponds to the unified angular extension or to an integral multiple of this unified angular extension.

Through the modularity achieved through these measures, individual modules can be dismantled or fitted in other places as desired and exactly in the place stipulated, without the necessity for time consuming adjustment work.

The adjustment of the individual modules can be done in advance by setting up the components of the modules on special setting fixtures, so that it is certain that the setting in operation is correct for the card assigned. This pre-setting of the components is easily carried out with their own modules and, in any case, the individual equipment is easily accessible, so that it is relatively easy to measure and adjust the available clearance.

With this modularity concept, there are no limitations with regard to the availability of the equipment of the card. For example, the equipment named can be selected from the following examples:

(a) Card rods;
(b) Guide rods;
(c) Knife rods;
(d) Knife and card clothing;
(e) Main cylinder cover plates;
(f) Suction units; and
(g) Transverse conveyor cleaning devices.

With the conception of the individual equipment: it is only necessary to ensure that each has an angular extension around the main cylinder, which is selected to correspond to the unified angular extension or an integral multiple thereof. "Correspond" must not be taken to mean that the angular extension of the individual units is specified exactly but rather that, as a rule, it should not be greater than an integral multiple of the unified angular extension and can also be smaller. Consequently, the design must not be subjected to unnecessary limitations, but rather a type of pattern is specified, in which everything must fit.

The recarding zone and/or the intermediate carding zone and/or the main carding zone can also be subdivided into a multiplicity of angular ranges which have the same unified angular extensions as the angular ranges of the pre-carding zone. With this design, the different modules can also be fitted in those areas, for example, where a revolving flat of the main carding zone could be replaced by stationary carding equipment, if this appears desirable in a particular case.

In a preferred arrangement, the successive carding zones are subdivided into a multiplicity of angular ranges, which have the same unified angular extension as the angular ranges of the pre-carding zone, whereby each zone lies directly adjacent a preceding zone without forming a gap between the neighbouring unified angular ranges. Through this, the space available is completely utilized in harmony with the desired modularity.

If, as is usual, a revolving flat arrangement is provided in the main carding zone, then it is appropriate when every revolving flat of the revolving flat arrangement, has essentially the unified angular extension related to the axis of the main cylinder. With such an arrangement, standardized needle clothing can be used for the revolving flat as well as for stationary flats with needle clothing and this favors stockkeeping as well as reducing production costs for needle clothing.

It is also possible to subdivide the circumference of the licker-in into unified angular ranges for receiving tool modules.

According to a form of construction which is particularly preferred, every fastening plate has an angular extension, related to the axis of the main cylinder, which amounts to the quadruple of the unified angular extension.

This construction of the fastening plate with an angular extension, that is a width which corresponds to the quadruple of the unified angular extension, leads to modules which are easy to manipulate. For example, modules can be made available with the following equipment, viewed in the circumferential direction of the main cylinder:

(a) Four card rods with the same clothing;
(b) Four card rods with various clothing;
(c) One guide rod, one knife rod, two card rods;
(d) One card rod, one guide rod, one knife rod, one card rod;
(e) Two card rods, one guide rod, one knife rod;
(f) One main cylinder cover plate;
(g) Equipment as (a) to (f), whereby one or more of the four carding units are replaced by a main cylinder cover plate; and
(h) One transverse conveyor cleaning device.

The carding equipment is preferably held on the fastening plates by means of spring clips, whereby all the spring clips are formed in the same way and have an angular extension around the axis of the card which is the same or smaller than the unified angular extension. In particular, the spring clip can be formed according to the German Patent Application No. P 38 11 679.0, the disclosure of which is hereby incorporated by reference. A very convenient fitting of the individual carding equipment on the fastening plates is achieved through the use of spring clips of the same form. In addition, these spring clips, especially those according to the German Patent Application P No. 38 11 679.0, offer reliable fixing and positioning of the individual items of the card equipment and, at the same time, ensure that thermal deformations appearing in operation can be taken up, without endangering the operation of the card or the integrity of the individual component parts.

The fastening bolts of the fastening plates are preferably so arranged that they are spaced in the axial direction of the main cylinder outwardly of the spring clips. In this way, the fastening bolts can be tightened without the necessity for slackening the spring clips from the fastening plates, in order to achieve the necessary access to the fastening bolts or the receiving holes.

In a preferred embodiment, the fitting surfaces for the fastening plates on the card shells and the faces of the fastening plates themselves are to be finished to the same dimensions so as to be usable with all cards produced according to the invention and so that the modules can be exchanged between individual cards without any problems.

Care should be taken to ensure that the clearances between the holes for receiving the bolts for fitting the fastening plates on the card shells are selected to be the same and suited to the angular extension, whereby every hole must also be positioned according to the modular subdivision of the surface of the card. This ensures that the modules can be fitted on the card in any desired sequence, even when using modules with differing angular extensions, which is basically possible.

BRIEF DESCRIPTION OF THE DRAWINGS

The invention is explained in more detail by way of example with reference to the drawings, in which.

DETAILED DESCRIPTION OF THE PREFERRED EMBODIMENTS

Figure 1:
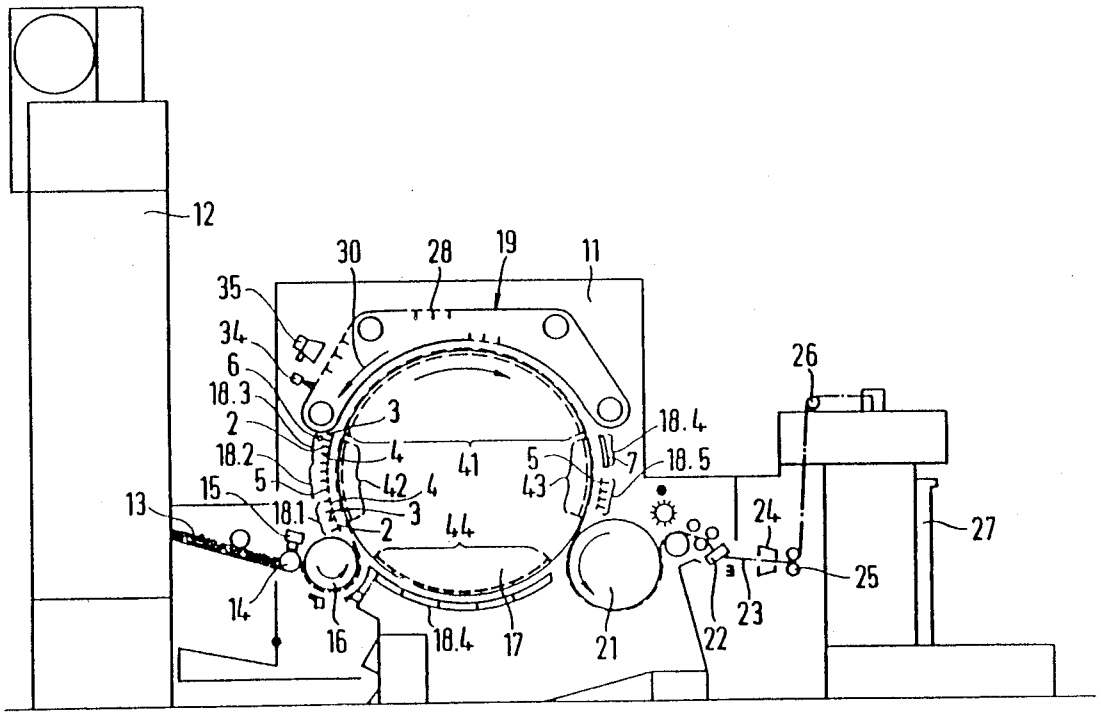
FIG. 1 is a schematic front view of a card.

FIG. 1 shows a side view of a card 11 which treats flock coming from a flock storage unit 12. The flock, in the form of cotton wool 13, is stored between a feed roller 14 and a feed plate 15 and is taken in the form of single cotton fibres licker-in 16 to a main cylinder 17 and then move past three modules 18.1, 18.2 and 18.3 until theY come into a revolving flat arrangement 19.

The module 18.1 consists of a guide rod 2 (see FIG. 9 for example), a knife rod 3 and two saw tooth clothing carrying card rods 4. The module 18.2 consists of four card rods 5 carrying wire clothing and the module 18.3 consists of a card rod 4, a guide rod 2, a suction device 6 and a knife rod 3. The module 18.3 could also consist of a transverse conveyor arrangement, for example, preferably that described in the German Patent Specification No. 26 24 367, the disclosure of which is hereby incorporated by reference.

After the revolving flat arrangement, the combed out cotton fibres travel underneath two further modules 18.4 and 18.5, until they are taken off by a doffer 21 and brought together over a transverse conveyor 22 into a fibre sliver 23 which passes through a funnel 24, measuring rollers 25, over a guide roller 26 and into a can 27. The module 18.4 consists of a main cylinder cover plate 7 and the module 18.5 consists of four card rods with needle clothing.

The revolving flat arrangement 19 consists of individual flats 28 (also shown in FIG. 2) which are carried at each end by chains 29 running along a path in the direction of arrow 30. Each flat 28 carries a clothing covering made from fine wire needles (not shown). In the lower path of the rotating chain, the needles are arranged downwards in a direction facing similar wire needles carried by the main cylinder 17. Accordingly, in the upper path, the needles are directed outwards and upwards. Through the combing effect resulting from the flats and the main cylinder, some fibres are detached from the revolving flat needle clothing together with soiling. The collection of fibres on the revolving flat arrangement form so-called card strips, which must be removed from the revolving flat arrangement. A comb 34 and a suction device 35 serve this purpose.

The comb 34 stretches over the entire length of the revolving flat, that is, essentially over the entire width of the card, which extends perpendicularly to the plane of FIG. 1. The region of the joint operation between the revolving flat arrangement 19 and the main cylinder 17 is known as the main carding zone 41. A pre-carding zone 42 precedes the main carding zone 41 and extends from the licker-in 16 to the start of the revolving flat arrangement 19 and is immediately upstream of and adjacent to the main carding zone 41. A recarding zone 43 is located immediately downstream of and adjacent to the main carding zone 41 and extends from the revolving flat arrangement 19 to the doffer 21 An intermediate carding zone 44 is located between the doffer 21 and the licker-in 16, which in this example, is occupied by a cover plate module 18.4.

Figure 2:
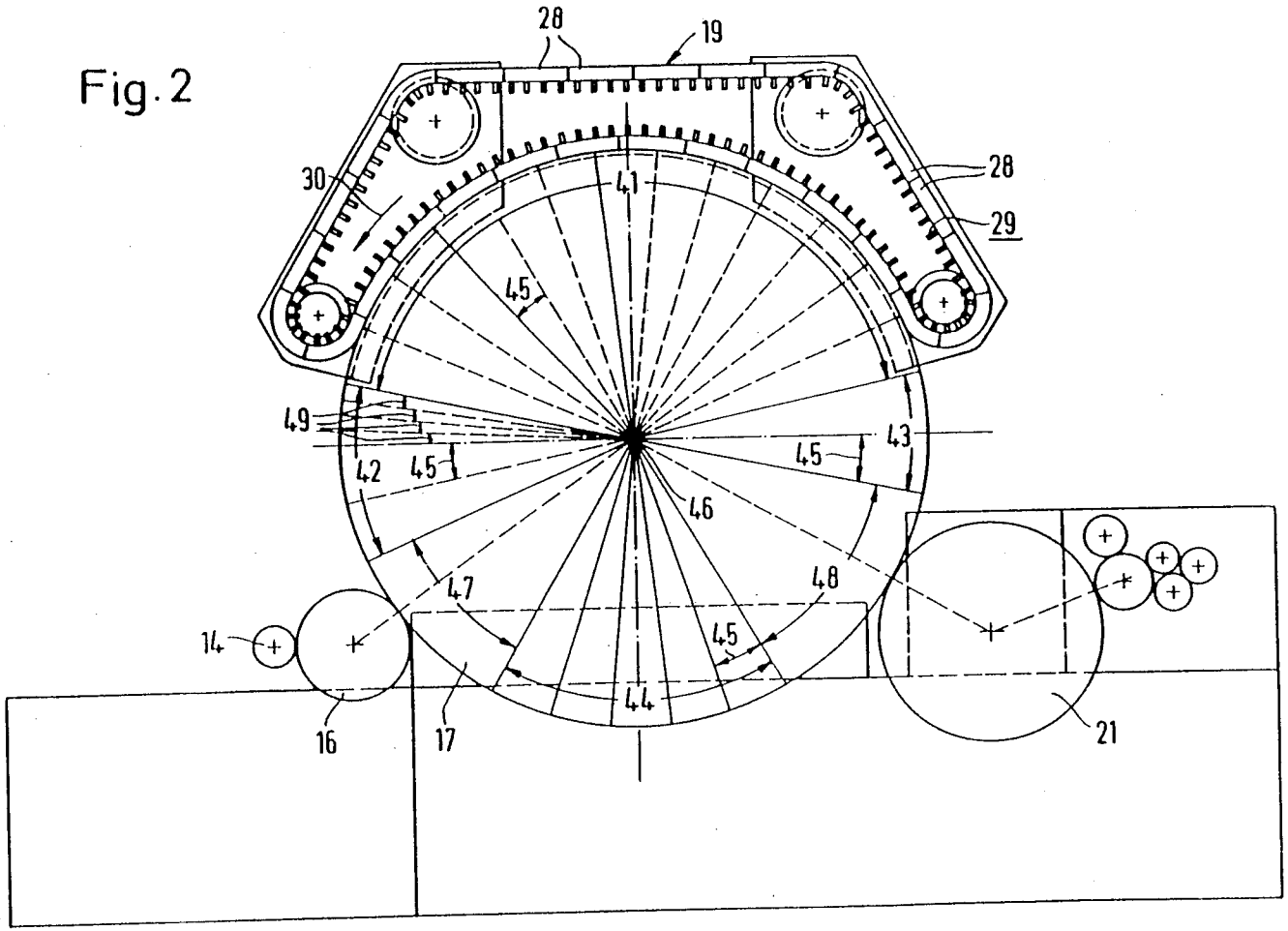
FIG. 2 is an enlarged simplified representation from the front face of the main cylinder shown in FIG. 1, in order to show the subdivision of the main cylinder into angular ranges.

FIG. 2 shows this subdivision of the card into regions on a larger scale. From FIG. 2 it can be seen that, with the exception of two regions 47 and 48, which are located near the licker-in 16 or the doffer 21 and which are unsuitable for receiving the card equipment because of technological considerations, the pre-carding zone 42, the recarding zone 43 and the main carding zone 41 are all subdivided into a multiplicity of identical angular ranges 45. Expressed more exactly, the pre-carding zone 42 encompasses three such angular ranges 45, the main carding zone 41 includes thirteen such angular ranges 45 and the recarding zone 43 includes two such angular ranges 45. In practice, these angular ranges 45 are selected so that they form an angle of about 12° about the axis of the main cylinder. The individual modules 18.1, 18.2, 18.3 and 18.4 of the card according to FIG. 1, each have an angular extension on the circumference of the card which corresponds to the angular range 45. This angular range is further subdivided into four unit ranges 49 (see FIG. 2) which, in each case, form an angle of 3° about the axis 46 of the main cylinder. Every tool of the card, e.g. guide rod, knife, card rod, cleaning device, cover plate, etc. has an angular extension which corresponds with a unit range or, when the occasion arises, several unit ranges.

As is further explained in the following, a pair of fastening plates 51 situated opposite to each other is provided for every angular range 45 on the frontal area of the card, whereby every fastening plate carries tooling with an angular extension, which amounts to a single, double, triple or quadruple multiple of the angular range 45 related to the axis of the main cylinder. A front view of such a fastening plate 51 with four card rods 5 fitted to it, can be seen in FIG. 3. A further fastening plate 51.1 is located adjacent one end of this fastening plate 51 and another fastening plate 51.2 is located adjacent the other end of the fastening plate 51. Fastening plates 51.1 and 51.2 are only partially represented, but they are, however, identical with the fastening plate 51. The four card rods 5 are fastened on the fastening plate with spring clips 52. The exact arrangement and layout of the fastening plates and the spring clips are now explained with the aid of FIG. 3 and, additionally, FIGS. 4 to 8.

Figure 4:
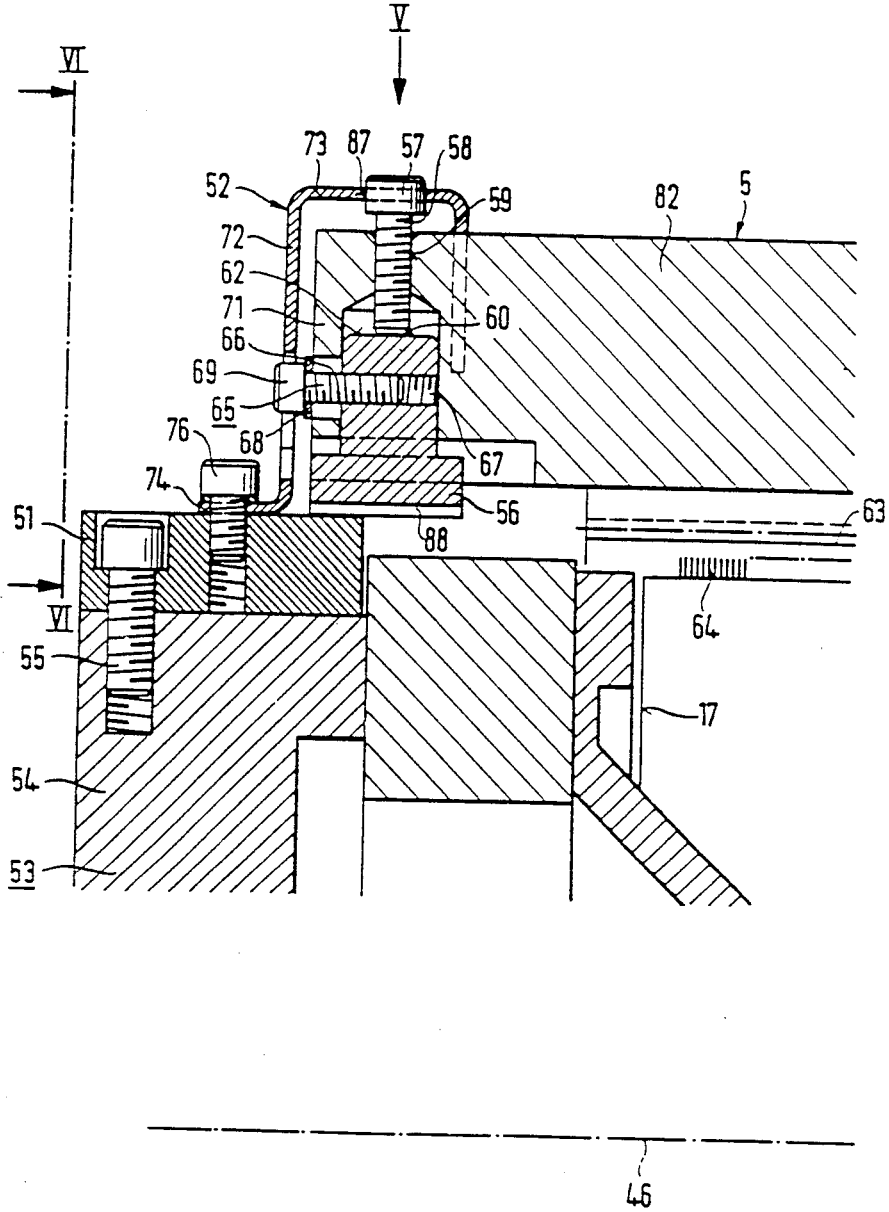
FIG. 4 is a section along the arrows IV—IV of FIG. 3, with additional details of the card.
Figure 5:
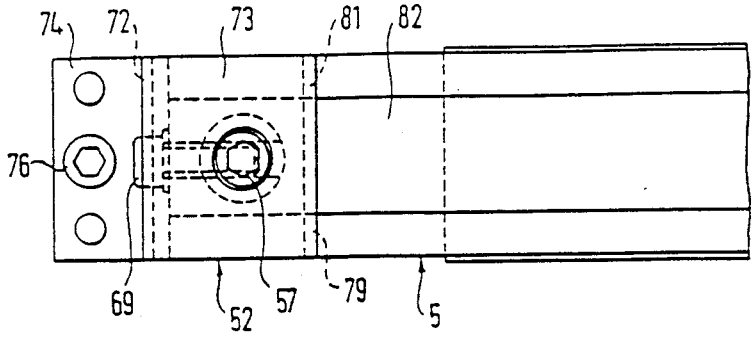
FIG. 5 is a top view of the arrangement shown in FIG. 4 in the direction of the arrow V.

As can be seen in particular in FIG. 4, a casing 53 of the card has a fixed flange 54, which is a component part of the casing and which extends in the form of a ring around the axis of the main cylinder 17. This flange 54 belongs to the so-called card shell. The fastening plate 51 is fastened on the mounting flange 54 by means of screws 55 extending in a radial direction. Every card rod 5 is pressed against the mounting flange by means of a spring clip 52 on each end of the card rod 5.

The supporting of the two ends of each card rod 5 is effected over the fastening plate 51 by means of a setting block 56, the upper part of which is guided in a radial direction in a guide extending into the end of the card rod. An adjusting screw 57 is located above the setting block 56 and includes a thread 58 which is threadedly engaged with a corresponding thread 59 in the card rod 5. An end 60 opposite to the manipulating knob of the adjusting screw 57 reaches to a radial outer surface 62 of the setting block 56 and, in this way, supports the end of the card rod 5, whereby, the desired radial clearance between needle clothing 63 of the card rod and needle clothing 64 of the main cylinder 17 can be set by turning the screw 57.

A lock screw 65 extends at right angles to the adjusting screw 57, that is, parallel to the axis 46 of the main cylinder 17 and includes a thread 66 threadedly engaged with a corresponding internal thread 67 of the setting block 56. A washer 68 is located underneath the manipulating knob 69 of the lock screw 65, so that the setting block 56 is drawn against an outer sidewall 71 of the card rod 5 and is clamped firmly when the lock screw 65 is tightened. In this way, the set clothing clearance is fixed.

Figure 6:
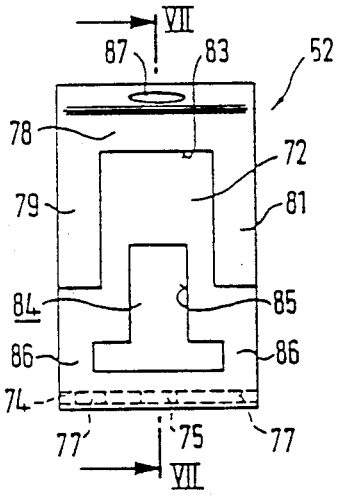
FIG. 6 is side view of the spring clip in FIGS. 3, 4 and 5, in the direction of the arrows VI in FIG. 4.
Figure 7:
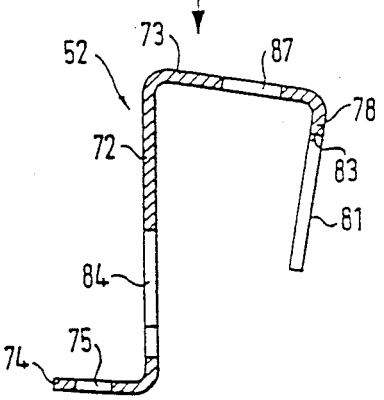
FIG. 7 is a cross section of the spring clip in an unloaded condition along the sectional plane VII—VII shown in FIG. 6.
Figure 8:
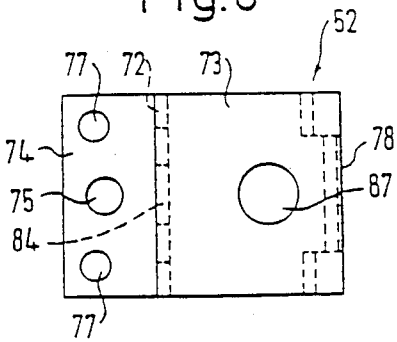
FIG. 8 is a top view of the spring clip in the preceding figures in the direction of the arrow VIII shown in FIG. 7.

The exact design of the spring clip 52 is shown in more detail in FIGS. 6, 7 and 8. As shown in FIG. 7, the spring clip can comprise a bent, flat spring steel strip having a first leg 72 joined to a first end of a second leg 73, the second leg 73 forming an angle of 80° with the first leg 72. The first leg 72, has an angular part 74, which has a screw hole 75, with which the spring clip 52 can be fastened on the fastening plate 51 with a screw 76 (FIG. 4). The angular part 74, of the spring clip also has two further holes 77, which are provided for receiving setting plugs, in order to determine the exact position of the spring clip on the fastening plate 51. The second leg 72 also has an angular part 78 on the end opposite to the first end, which is fork shaped. The two prongs 79, 81 of the fork shaped part 78, when installed as in FIG. 4, extend along both sides of a bracing rib 82 of the card rod 5, whereby an edge 83 of an opening between the prongs 79, 81 presses on the upper side of the bracing rib 82.

The first leg 72 of the spring clip 52 has an inverted T-shaped slot 84, of which the vertical extending part 85 forms an oblong hole, through which the manipulating knob 69 of the lock screw is accessible. The threaded part 66 of the lock screw 65 also extends through an aperture, likewise formed as an oblong hole in the outer sidewall 71 of the end of the card rod 5, so that the lock screw 65 is effective over the entire adjustment range of the adjusting screw 57. Since the knob 69 of the lock screw 65 remains accessible over the entire adjustment range through the oblong hole 85, the spring clip 52 can be tightened when installed. Furthermore, the width of the oblong hole 85 is selected to be exactly as large as the diameter of the knob 65 of the lock screw 65.

In this way, the position of the card rod 5 in the circumferential direction of the card is exactly specified by the clamping action of the spring clip 52 and the lock screw 65. The combination of the clip 52 and the lock screw 65 also forms a guide which permits axial elongation of the card rod 5.

The opening forming the cross-bar of the T-shaped slot 84 is separated from opposite edges of the first leg 72 by two narrow areas 86 which determine the flexibility of the spring clip 52 in the axial direction. It should be noted that these areas 86 can be sized such that the spring force of the spring clip 52 in the axial direction and in the radial direction can be selected to be different, whereby optimal suitability to the structural conditions relating to fastening of the card rod can be achieved. In other words, the axial resistance of the spring clip 52 can be selected through the objective choice of the cross section of the areas 86 in such a way that it is considerably less than the radial resistance. The axial force transmission of the card rod 5 on the spring clip 52 is effected by the knob of the adjusting screw 57.

In a manner similar to the arrangement of the locking screw 65 and opening 84, the manipulating knob of the adjusting screw 57 extends through an opening 87 in the second leg 73 of the spring clip, so that this screw is also accessible and can be manipulated when installed.

It should be noted that the setting block 56 has two guide ribs 77 extending in the axial direction on each side of an end of the card rod 5, the ribs being arranged with clearance therebetween so that they can be moved in the axial direction on the fastening plate 51.

Figure 3:
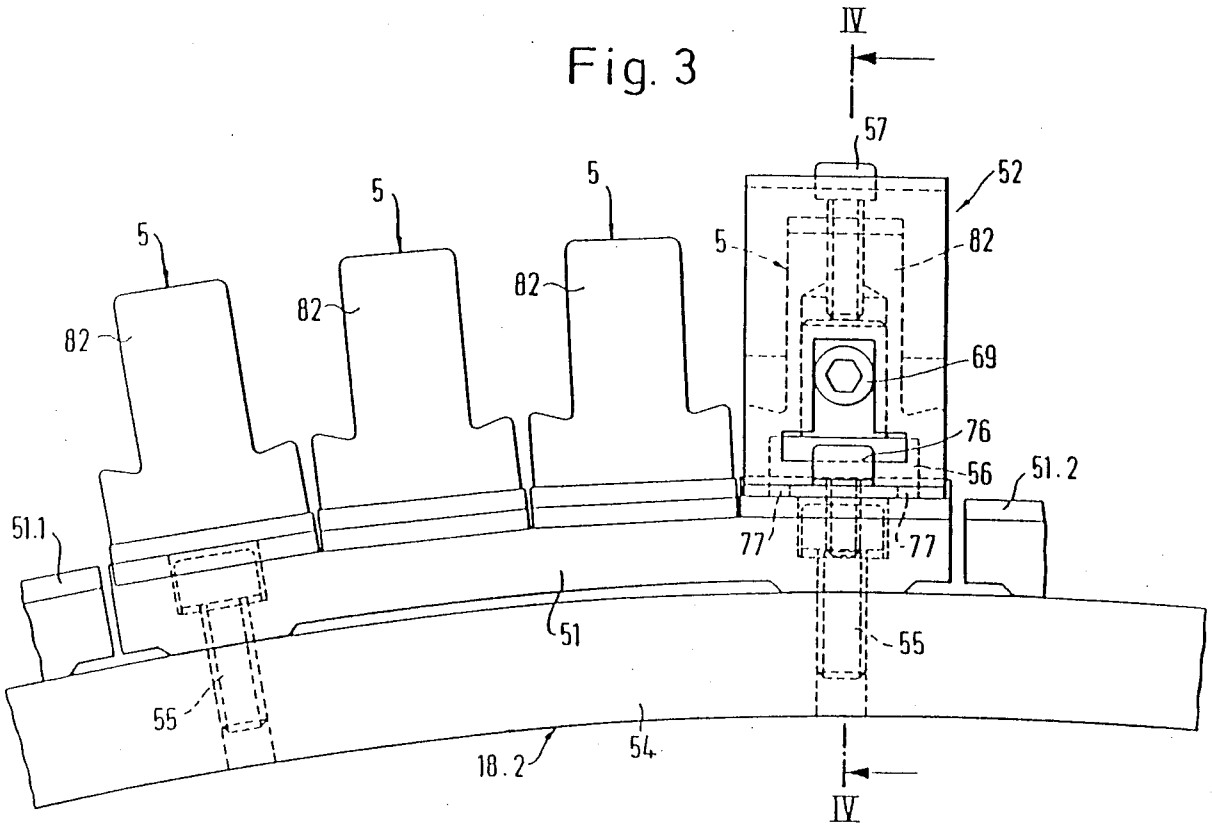
FIG. 3 is a front view of a fastening plate.

The assembly of the module according to FIGS. 3 and 4 is effected by providing a setting fixture, which corresponds dimensionally to part of the main cylinder 17 and the card casing 53. The fastening plates 51 are fastened on the fastening flanges 54 of the setting fixture with fastening screws 55. Subsequently, the card rods 5 are fitted to the fastening plates 51 which have the setting blocks 56 already fitted thereon. The spring clips 52 are then successively fitted in such a way that the fork shaped end 78 of each spring clip is next fitted over the bracing rib 82 of the respective card rod 5, so that the manipulating knob of the adjusting screw 57 protrudes through the opening 87 of the spring clip 52 or is at least accessible therethrough. Then, the screw 76 is fitted and tightened. During the tightening of the screw 76, the angle between the first and second legs 72, 73 of the spring clip 52 alters from the initial value according to FIG. 7 to an operating value of 90°, as shown in FIG. 4. Through this, the desired retaining force is produced on the stationary card rods 5. The screw 76, therefore, not only serves for holding the spring clip 52 when it is fitted, but also simultaneously deforms the spring clip 52 to apply tension on the card rod 5.

After the screw 76 has been tightened, the adjusting screw 57 is turned until the desired clothing clearance is attained. This clearance can easily be checked on the setting fixture, as the card rods are then easily accessible over the entire length thereof from the side, that is, from the circumferential direction with respect to the axis of the main cylinder. After the desired clothing clearance has been obtained, the lock screw 65 is tightened, in order to safeguard the set position of the card rod. Then, the fastening screws 55 can be released and the module built up on a card. As long as the correct clothing clearance has been selected on a setting fixture with regard to the actual diameter of the main cylinder where the module is to be used, the nominal clothing clearance can be preserved on assembly of the module.

Even if the spring clip 52 and the fastening plates 51 should be removed from the card rods 5 for transport purposes, the given setting is still maintained, as the setting block 56 retains its position with regard to the card rod and the respective fastening plate 51 because of the lock screws 65. If thermal expansions arise in the card room during operation, the setting block 56 and the lock screw 65 can move in the guide formed by the prongs 79, 81 of the spring clip 52, whereby the holding down force remains constant and the elasticity of the spring clip 52 prevents forces being exercised on the card rods 5 which could themselves lead to a deformation. In other words, the linear expansion of the card rods is favored and the fastening itself, however, is ensured without fault.

Figure 9:
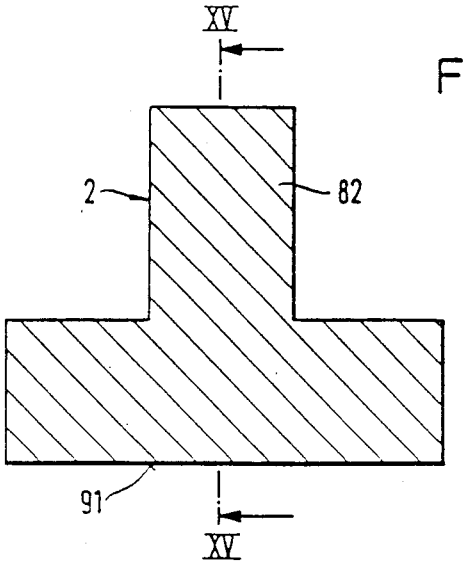
FIG. 9 is a cross section through a guide rod.

FIG. 9 shows a cross section of a guide rod 2, which shows an angular expansion in the circumferential region of the main cylinder which is the same as the unified angular extension. The guide rod 2 has a constant cross section, at least essentially over its entire length, as shown in FIG. 9. In particular, the guide rod 2 has a longitudinal rib 82, which is formed to correspond to the longitudinal rib 82 of the card rod 5 from FIGS. 3 and 4. The ends of the guide rod 2 are also formed in the same way as the ends of the card rods 5. Further, the height of the guide rod is so chosen that it can be fastened on the fastening flanges 54 with the same spring clips 52 as the card rods 5. The underside 91 of the guide rod, which is shown as flat, is so set that it is essentially the same distance away from the clothing as the points of the wire clothing shown on the card rod 5 in FIGS. 3 and 4.

Figure 10:
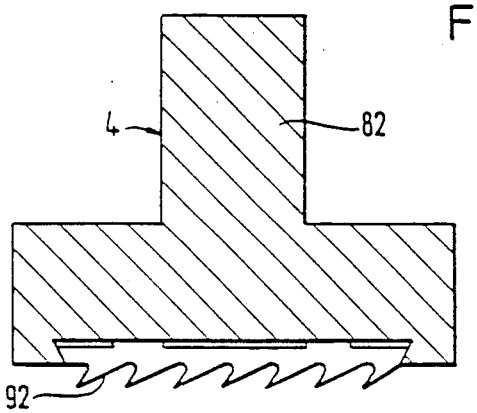
FIG. 10 is a cross section through a card rod with saw tooth clothing.

FIG. 10 shows a further card rod 4, shown in cross section, which is equipped with saw tooth clothing 92 instead of wire clothing. It can be clearly seen that this card rod also has a rib 82 corresponding with that of the card rod 5. This card rod 4 also has ends according to FIG. 10, which are formed according to the card rod 5 and it can also be fastened with the same spring clips 52 on the fastening plates 51.

Figure 11:
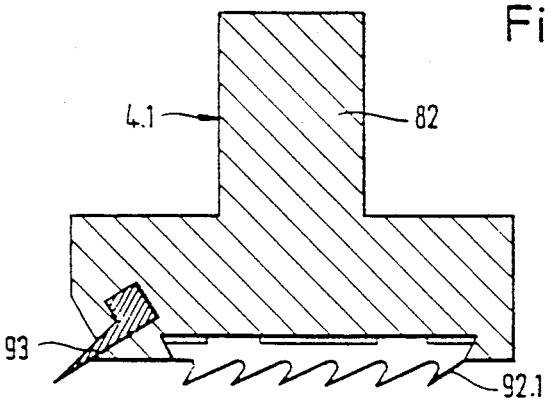
FIG. 11 is a cross section through a card rod similar to that in FIG. 10, however combined with a knife.

FIG. 11 shows a modified card rod 4.1, which carries a knife strip 93 in addition to the saw tooth clothing 92.1. This card rod also has the usual longitudinal rib 82 and the ends are so formed that it can also be fastened by means of the spring clips 52 and the fastening plates 51, in exactly the same way as the card rod 5 in FIGS. 3 and 4, as well as the guide rod 2 in FIG. 9 and the card rod 4 in FIG. 10.

Figure 12:
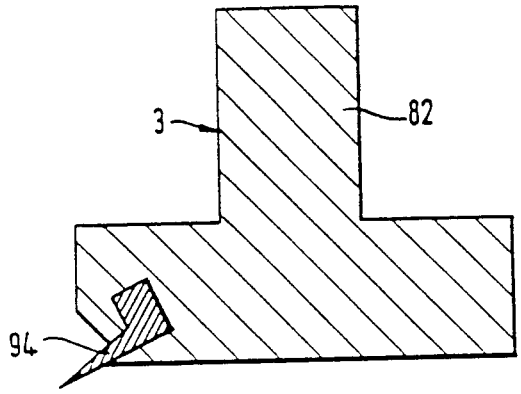
FIG. 12 is a cross section through a knife rod.

FIG. 12 shows a knife rod 3 with knife 94. From this cross section it can also be seen that the knife rod 3 has the typical longitudinal rib 82. This rod also has ends which are formed like the card rod 5 and can also be fastened by means of the spring clips 52 and the fastening blocks 56 on the fastening plates 51. The guide rod 2, the card rod 4, the modified card rod 4.1, the knife rod 3 and the card rod 5 also have an angular extension related to the axis of the main cylinder, which corresponds to the unified angular extension, that is, 3°.

Figure 13:
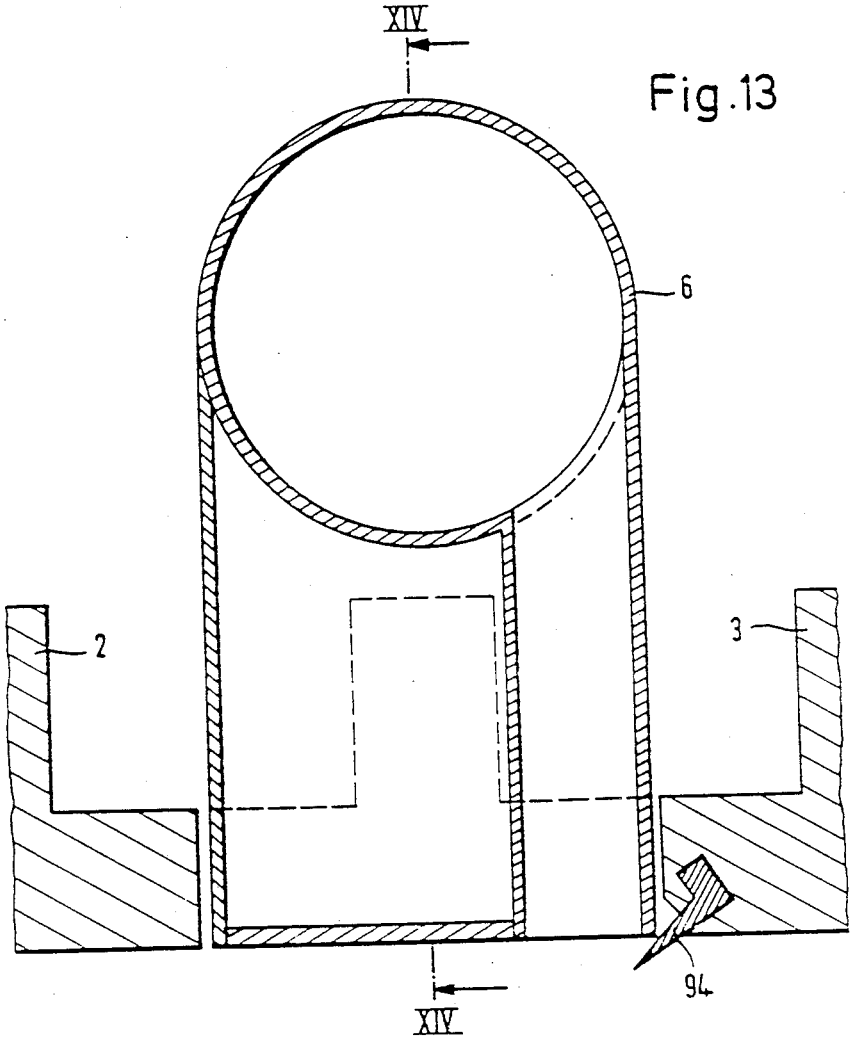
FIG. 13 is a cross section through a suction device.
Figure 14:
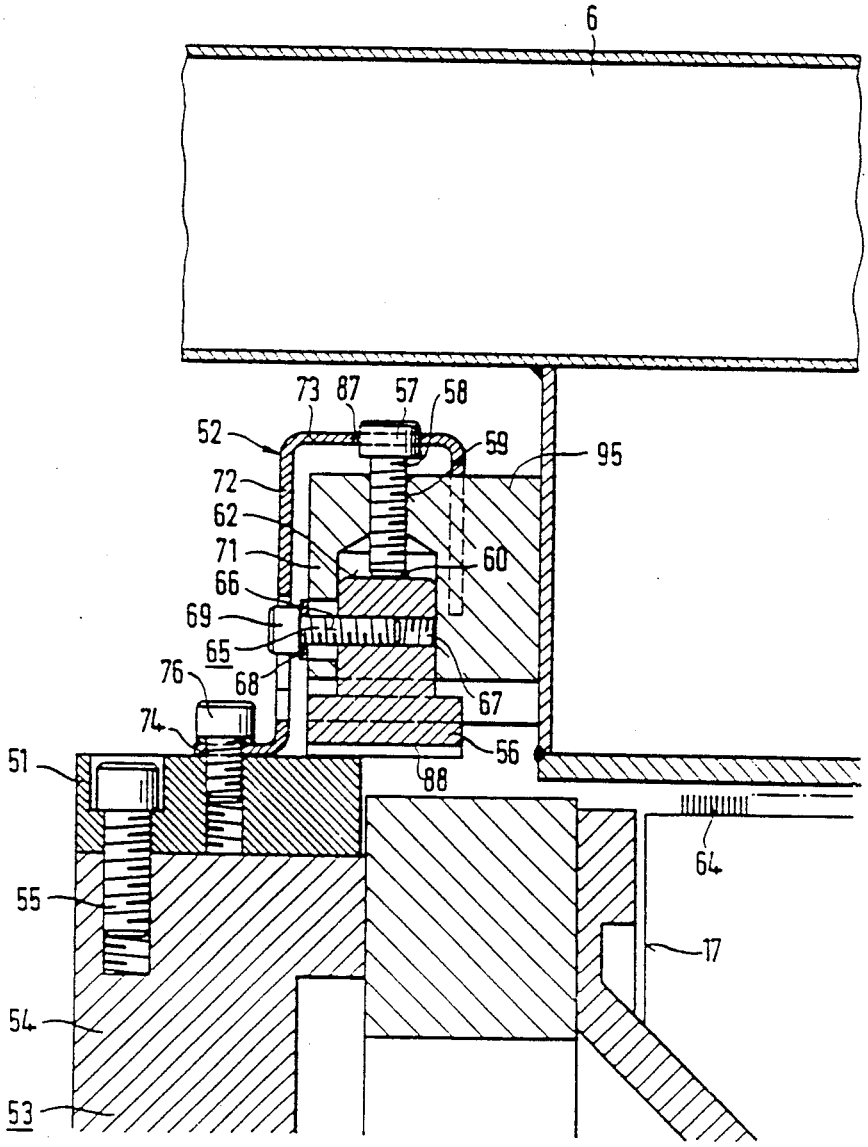
FIG. 14 is a partial longitudinal section through the suction device in FIG. 13 on the plane XIV—XIV.

FIG. 13 shows a cross section through a cleaning device in the form of a suction unit 6 which has a width, measured in the circumferential direction of the main cylinder, which, at least on the underside related to the main drum, amounts to the unified angular extension of 3°. It can be seen in the representation according to FIG. 13 that a guide rod 2 is arranged in front of the cleaning device and a knife rod 3 is arranged after the cleaning device. As can be seen, in particular in FIG. 14, the suction unit 6 has a fastening device 95 at opposite ends thereof which correspond to the previously described ends of the card rod 5. These ends also correspond to the ends of the other rods previously described. In this way, the suction unit 6 can be fitted to the fastening plates 51 with the same spring clips 52 and fastening blocks 56 and can also be adjusted.

Figure 15:
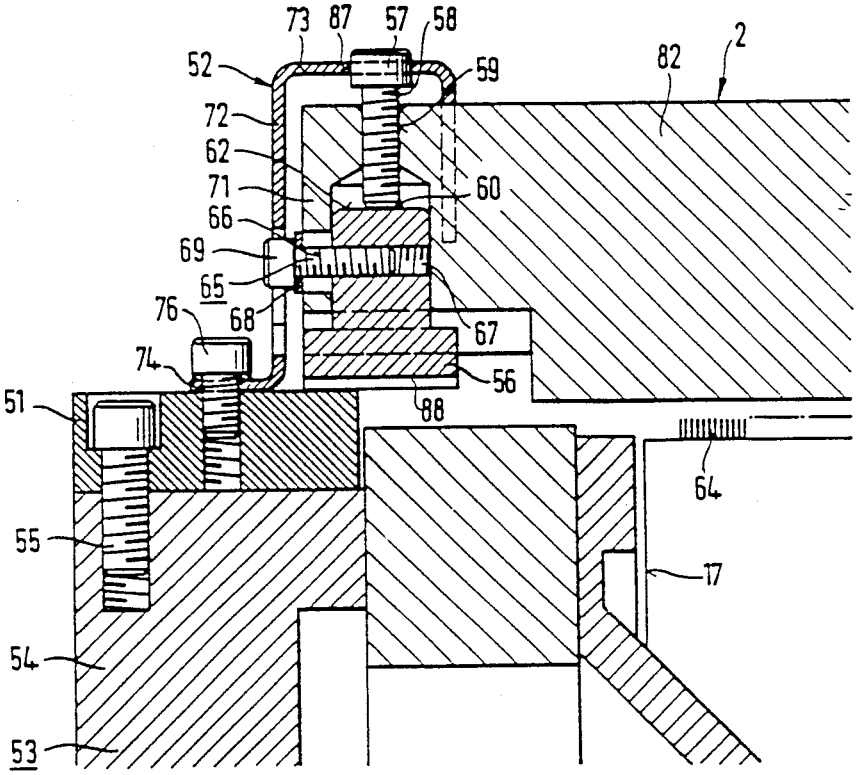
FIG. 15 is a partial longitudinal section through the guide rod of FIG. 9 on the plane XV—XV with additional details of the fastening on the card flanges.

FIG. 15 shows how the guide rod 2 in FIG. 9 can likewise be fitted and adjusted on the fastening plate 51 by means of the spring clips 52 and fastening blocks 56 already described.

Figure 16:
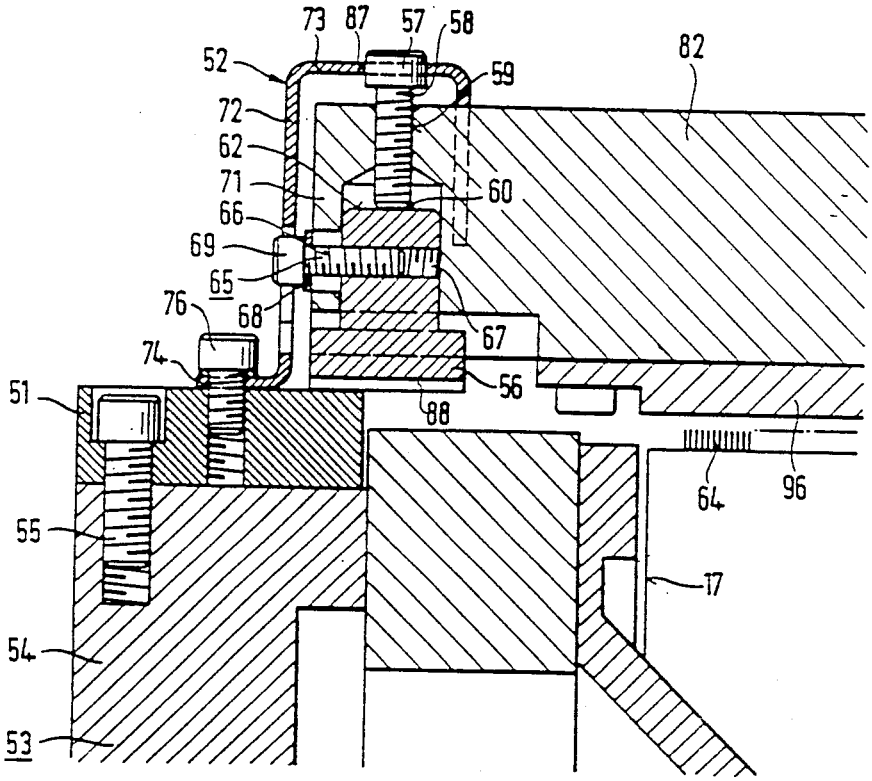
FIG. 16 is a partial longitudinal section through a rod, on which a card cover plate is fastened.

Finally, FIG. 16 shows an arrangement wherein a main cylinder cover plate 96 can be provided with ribs 82 which correspond with the card 5 and can likewise be fastened and adjusted on the fastening plate 51 by the spring clips 52 and fastening blocks 56. Every cover plate 96 has an angular extension which is the same as the unified angular extension and four such cover plates 96 can be fitted adjacent to each other on two oppositely arranged fastening plates 51, in order to construct a cover module 18.4.

As already explained, all the equipment which can find a use on a card is fitted to the guide surfaces according to the modular principle of the invention. Although, fastening by means of spring clips is preferred in most cases, this is not compulsory, particularly in the case of a cover plate or cleaning device. It is clear, for example, that it is not necessary to maintain a very exact clearance between a cover plate and the main cylinder, as in this case it is sufficient when it has been verified that an adequate clearance is present.

Finally, it should be noted that it is completely feasible to provide modules with angular extensions which differ from the quadruple of the unified angular extension and it is completely feasible to use modules with different angular extensions on one and the same card at the same time, so far as every module is dimensioned according to the invention. If it is desired to use such modules having different angular extensions, additional holes which correspond with the unified pattern should be provided in the card flange, to enable such modules with different widths to be fastened perfectly. As an example, it is therefore suggested that at least one extra hole per unified angular extension should be provided in the card flange.

While the invention has been described with reference to the foregoing embodiments, changes and modifications may be made thereto which fall within the scope of the appended claims.

What is claimed is:

1. A carding machine comprising a licker-in, a main cylinder and a doffer, the carding machine including in a direction of rotation of the main cylinder a main carding zone which can include a flat arrangement, a pre-carding zone between the licker-in and the main carding zone, a recarding zone between the main carding zone and the doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the carding machine further including pre-adjusted modules carrying at least one pre-adjustable piece of equipment of the carding machine, the pre-adjusted modules being mountable in the subdivided zone of the carding machine, each pre-adjusted module including a pair of spaced-apart fastening plates, each of which is mountable on a respective side of the main cylinder and has an angular extension around the axis of the main cylinder corresponding to an integer of at least one times the unified angular extension, each pair of fastening plates including means for mounting thereon at least one pre-adjustable piece of equipment of a card having an angular extension around the axis of the main cylinder corresponding to an integer of at least one times the unified angular extension.

2. A card according to claim 1, wherein the pre-adjustable piece of equipment of the card is selected from the group consisting of card rods, guide rods, knife rods, knife and card clothing rods, card cylinder cover plates, suction units, and transverse conveyor cleaning devices.

3. A card according to claim 1, wherein the subdivided at least one zone includes the pre-carding and recarding zones.

4. A card according to claim 1, wherein the subdivided at least one zone includes the pre-carding and main carding zones.

5. A card according to claim 1, wherein the subdivided at least one zone includes the pre-carding, main carding and recarding zones.

6. A card according to claim 1, wherein the subdivided at least one zone includes the pre-carding, main carding, recarding and intermediate carding zones, at least two of these zones being adjacent each other without a gap between the angular ranges of these zones.

7. A card according to claim 1, wherein the main carding zone includes a revolving flat arrangement, each revolving flat of the revolving flat arrangement having a width measured in a circumferential direction around the axis of the main cylinder equal to the unified angular extension.

8. A card according to claim 1, wherein the pre-adjustable piece of equipment is pre-adjusted with respect to a clothing clearance between the main cylinder and a portion of the piece of equipment facing the main cylinder.

9. A card according to claim 1, wherein each of the fastening plates has an angular extension measured in a circumferential direction around the axis of the main cylinder which is equal to four times the unified angular extension.

10. A card according to claim 1, wherein each of the fastening plates has the same dimensions whereby the fastening plates can be used to assemble various types of cards usable with the carding machine.

11. A carding machine comprising a licker-in, a main cylinder and a doffer, the carding machine including in a direction of rotation of the main cylinder a main carding zone which can include a flat arrangement, a pre-carding zone between the licker-in and the main carding zone, a recarding zone between the main carding zone and the doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the carding machine further including modules carrying at least one piece of equipment of the carding machine, the modules being mountable in the subdivided zone of the carding machine, each module including a pair of spaced-apart fastening plates, each of which is mountable on a respective side of the main cylinder and has an angular extension around the axis of the main cylinder corresponding to an integer of at least one times the unified angular extension, each pair of fastening plates including means for mounting thereon at least one piece of equipment of a card having an angular extension around the axis of the main cylinder corresponding to an integer of at least one times the unified angular extension, and the licker-in having a circumference subdivided into angular ranges, each of which is equal to the unified angular extension for receiving tool modules.

12. A carding machine comprising a licker-in, a main cylinder and a doffer, the carding machine including in a direction of rotation of the main cylinder a main carding zone which can include a flat arrangement, a pre-carding zone between the licker-in and the main carding zone, a recarding zone between the main carding zone and the doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the carding machine further including modules carrying at least one piece of equipment of the carding machine, the modules being mountable in the subdivided zone of the carding machine, each module including a pair of spaced-apart fastening plates, each of which is mountable on a respective side of the main cylinder and has an angular extension around the axis of the main cylinder corresponding to an integer of at least one times the unified angular extension, each pair of fastening plates including means for mounting thereon at least one piece of equipment of a card having an angular extension around the axis of the main cylinder corresponding to an integer of at least one times the unified angular extension, each of the fastening plates having an angular extension measured in a circumferential direction around the axis of the main cylinder which is equal to four times the unified angular extension, and each of the modules including equipment selected from the group consisting of: (a) four card rods with the same clothing; (b) four card rods with various clothing; (c) one guide rod, one knife rod and two card rods; (d) one card rod, one guide rod, one knife rod and one card rod; (e) two card rods, one guide rod and one knife rod; (f) one main cylinder cover plate; (g) at least one main cylinder cover plate and at least one piece of equipment selected from a card rod, a guide rod and a knife rod; and (h) one transverse conveyor cleaning device.

13. A carding machine comprising a licker-in, a main cylinder and a doffer, the carding machine including in a direction of rotation of the main cylinder a main carding zone which can include a flat arrangement, a pre-carding zone between the licker-in and the main carding zone, a recarding zone between the main carding zone and the doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the carding machine further including modules carrying at least one piece of equipment of the carding machine, the modules being mountable in the subdivided zone of the carding machine, each module including a pair of spaced-apart fastening plates, each of which is mountable on a respective side of the main cylinder and has an angular extension around the axis of the main cylinder corresponding to an integer of at least one times the unified angular extension, each pair of fastening plates including means for mounting thereon at least one piece of equipment of a card having an angular extension around the axis of the main cylinder corresponding to an integer of at least one times the unified angular extension, and the mounting means including spring clips, each of which has an angular extension around the axis of the card cylinder which is no greater than the unified angular extension.

14. A card according to claim 13, further comprising fastening bolts for attaching the fastening plates to a casing of the carding machine, the bolts being spaced outwardly in the axial direction of the main cylinder away from the spring clips.

15. A card according to claim 14, wherein clearances are provided between holes in the casing for receiving the bolts fitting the fastening plates on the casing, the clearances being selected to be the same and suited to the angular extension, whereby each of the holes is positioned according to the modular subdivision of the surface of the card.

16. A pre-adjusted module for a carding machine including in a direction of rotation of a main cylinder a main carding zone which can include a flat arrangement facing a portion of the main cylinder, a pre-carding zone between a licker-in and the main carding zone, a recarding zone between the main carding zone and a doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the pre-adjusted module comprising:

a pair of spaced-apart fastening plates, each of the fastening plates being mountable in the carding machine at a respective axial end of the main cylinder and having an angular extension around the axis of the main cylinder when mounted in the carding machine corresponding to an integer of at least one times the unified angular extension, the pair of fastening plates including means for mounting thereon at least one pre-adjustable piece of equipment of the carding machine so that the at least one pre-adjustable piece of equipment is adjustable and can be preset at a desired position in a radial direction with respect to a rotation axis of the main cylinder prior to mounting of the pre-adjusted module in the carding machine, the pre-adjusted module being mountable in the subdivided zone of the carding machine.

17. A pre-adjusted module according to claim 16, wherein the pre-adjusted module carries the at least one pre-adjustable piece of equipment, the at least one pre-adjustable piece of equipment of the card being selected from the group consisting of card rods, guide rods, knife rods, knife and card clothing rods, card cylinder cover plates, suction units, and transverse conveyor cleaning devices.

18. A pre-adjusted module according to claim 17, wherein the at least one pre-adjustable piece of equipment is pre-adjusted such that a clothing clearance between the pre-adjustable piece of equipment and the main cylinder is already at a preselected value when the fastening plates are mounted in the carding machine.

19. A pre-adjusted module according to claim 16, wherein the fastening plates include fixing means for fixedly holding the fastening plates on a frame of the carding machine such that the fastening plates are not adjustable with respect to the frame in a radial direction.

20. A method of mounting a pre-adjusted module on a carding machine including in a direction of rotation of a main cylinder a main carding zone which can include a flat arrangement facing a portion of the main cylinder, a pre-carding zone between the licker-in and the main carding zone, a recarding zone between the main carding zone and the doffer and an intermediate carding zone between the doffer and the licker-in, at least one of the pre-carding, main carding, recarding and intermediate carding zones being subdivided with respect to an axis of rotation of the main cylinder into a plurality of angular ranges, each of which has an angular extension equal to an integer of at least one times a unified angular extension, the pre-adjusted module carrying at least one pre-adjustable piece of equipment of the carding machine, the pre-adjusted module being mountable in the subdivided zone of the carding machine and including a pair of spaced-apart fastening plates, each of which is mountable at a respective side of the main cylinder and has an angular extension around the axis of the main cylinder corresponding to an integer of at least one times the unified angular extension, each pair of fastening plates including means for mounting thereon the at least one pre-adjustable piece of equipment, the method comprising:

pre-adjusting the at least one pre-adjustable piece of equipment on the fastening plates by adjusting the pre-adjustable piece of equipment on a setting fixture such that when the pre-adjusted module is mounted in the carding machine a clothing clearance between a portion of the pre-adjustable piece of equipment and the main cylinder is at a preselected value; and mounting the pre-adjusted module on the carding machine after the pre-adjusting step.

21. The method of claim 20, wherein the pre-adjustable piece of equipment includes a first setting block adjustably connected to the pre-adjustable piece of equipment at a first axial end thereof and a second setting block adjustably connected to the pre-adjustable piece of equipment at a second axial end thereof, the pre-adjusting step being carried out by adjusting the first setting block relative to the first axial end of the pre-adjustable piece of equipment and by adjusting the second setting block relative to the second axial end of the pre-adjustable piece of equipment.

22. The method of claim 21, wherein each of the first and second setting blocks is supported on a respective one of the fastening plates, the first setting block being adjustably connected to the first axial end of the pre-adjustable piece of equipment by first screw means and the second setting block being adjustably connected to the second axial end of the pre-adjustable piece of equipment by second screw means, the pre-adjusting step being carried out by selectively adjusting the first and second screw means.

23. The method of claim 20, wherein the fastening plates include fixing means for fixedly holding the fastening plates on a frame of the carding machine such that the fastening plates are not adjustable with respect to the frame in a radial direction, the mounting step being carried out by fixing the fastening plates on the frame with the fixing means.

* * * * *